US007694385B2

(12) United States Patent
Choi et al.

(10) Patent No.: US 7,694,385 B2
(45) Date of Patent: Apr. 13, 2010

(54) BRUSH APPARATUS FOR A VACUUM CLEANER

(75) Inventors: Min-jo Choi, Gwangju (KR); Yun-sup Hwang, Gwangju (KR); Tae-gwang Kim, Incheon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 218 days.

(21) Appl. No.: 11/797,794

(22) Filed: May 8, 2007

(65) Prior Publication Data

US 2007/0283522 A1 Dec. 13, 2007

(30) Foreign Application Priority Data

Dec. 6, 2006 (KR) ..... 10-2006-0122793

(51) Int. Cl.
*A47L 5/10* (2006.01)

(52) U.S. Cl. ..... 15/391; 15/390; 15/389

(58) Field of Classification Search ..... 15/390, 15/391, 389, 332, 333
See application file for complete search history.

(56) References Cited

U.S. PATENT DOCUMENTS

| | | | | |
|---|---|---|---|---|
| 4,748,714 | A | 6/1988 | Tschudy | |
| 5,768,746 | A | 6/1998 | Kamatani et al. | |
| 6,044,520 | A | 4/2000 | Yamamoto | |
| 6,067,689 | A * | 5/2000 | Roney et al. | 15/390 |
| 6,098,243 | A * | 8/2000 | Kim | 15/390 |
| 6,209,168 | B1 | 4/2001 | Brickner et al. | |
| 6,640,386 | B2 | 11/2003 | Morgan et al. | |
| 6,918,156 | B2 | 7/2005 | Joo et al. | |
| 7,107,647 | B2 * | 9/2006 | Park | 15/390 |
| 7,120,964 | B2 * | 10/2006 | Roney | 15/391 |
| 7,418,764 | B2 * | 9/2008 | Gordon et al. | 15/354 |
| 2005/0086764 | A1 | 4/2005 | Lim et al. | |
| 2005/0120513 | A1 | 6/2005 | Lee et al. | |
| 2006/0005350 | A1 | 1/2006 | Kim et al. | |
| 2006/0130272 | A1 | 6/2006 | Oh et al. | |
| 2006/0200935 | A1 | 9/2006 | Lee et al. | |
| 2007/0067946 | A1 | 3/2007 | Song et al. | |
| 2007/0067949 | A1 | 3/2007 | Lee et al. | |

FOREIGN PATENT DOCUMENTS

| | | |
|---|---|---|
| GB | 974044 | 11/1964 |
| JP | 57-131420 | 8/1982 |
| KR | 101997018100 | 2/1999 |
| KR | 101997019671 | 2/1999 |
| KR | 101997035912 | 2/1999 |
| KR | 101997035918 | 7/1999 |
| KR | 1019980053221 | 8/2000 |
| KR | 10-2000-0075315 A | 12/2000 |
| KR | 10-2004-0087531 A | 10/2004 |
| KR | 10-2005-0061726 A | 6/2005 |
| WO | WO 02/080749 A2 | 10/2002 |
| WO | WO 02/082965 A2 | 10/2002 |

* cited by examiner

*Primary Examiner*—Dung Van Nguyen
(74) *Attorney, Agent, or Firm*—Blank Rome LLP

(57) ABSTRACT

A brush apparatus capable of controlling a drive of a brush member with a simplified structure and a vacuum cleaner having the same. The vacuum cleaner includes a rotatable brush member, a driving unit to drive the brush member, and a blocking unit disposed between the brush member and the driving unit to selectively block a driving force transmitted between the brush member and the driving unit. The driving unit includes a suction motor to generate a suction force, and a single continuous connecting belt connecting the suction motor and the blocking unit.

16 Claims, 5 Drawing Sheets

BRUSH APPARATUS FOR A VACUUM CLEANER

CROSS-REFERENCE TO RELATED APPLICATION

This application claims the benefit of Korean Patent Application No. 10-2006-0122793, filed on Dec. 6, 2006, in the Korean Intellectual Property Office, the disclosure of which is incorporated herein by reference in its entirety.

FIELD OF THE INVENTION

The present invention relates to a vacuum cleaner, and more particularly, to a brush apparatus of the vacuum cleaner, for cleaning a surface.

BACKGROUND OF THE INVENTION

Generally, a conventional vacuum cleaner has a brush member, which rotates while facing the surface to be cleaned. The brush member strikes or scratches that surface with a rotating force while the cleaner moves along the surface, thereby separating dust and dirt from the surface. The dust or dirt separated by the brush member is suctioned into a cleaner body by a suction force generated from the cleaner body, and collected therein.

If the brush member came into contact with a slick or smooth surface to be cleaned, such as a bare or hardwood floor, the slick surface may be damaged due to friction with the brush member.

To address that problem, some vacuum cleaners have a blocking means for selectively blocking the operation of the brush member. For example, the brush motor for driving the brush member may be provided separately from the suction motor for generating the suction force, allowing selective blocking of the drive of the brush member via an 'on' and 'off' switch operation.

Another example of a blocking means includes providing an idling bearing and two driving belts that are used to selectively block the drive of the brush member, which is rotated by the suction motor that generates the suction force.

However, both of the above, constructions are complicated, and increase fabrication costs due to multiple parts.

SUMMARY OF THE INVENTION

The present invention has been developed in order to address the above problems in the related art. Accordingly, an aspect of the present invention is to provide a brush apparatus having an improved construction to control an operation or drive of a brush member with a simple structure, and a vacuum cleaner having the same.

In order to achieve the above-described aspect of the present invention, there is provided a brush apparatus, including a rotatable brush member, a driving unit to drive the brush member, and a blocking unit disposed between the brush member and the driving unit to selectively block a driving force transmitted between the brush member and the driving unit. The driving unit may include a suction motor to generate a suction force, and a single continuous connecting belt connecting the suction motor and the blocking unit.

According to an exemplary embodiment of the present invention, preferably, but not necessarily, the blocking unit may include a power transmitting part to transmit a driving force transmitted from the connecting belt, to the brush member, and a blocking part to selectively block a driving force transmission between the brush member and the power transmitting part.

Preferably, but not necessarily, the power transmitting part may include a first connecting member connected with the connecting belt, a second connecting member connected with the first connecting member, and a third connecting member connected with the brush member.

Preferably, but not necessarily, the blocking part may include an operating lever to selectively block the driving force transmitted between the second connecting member and the third connecting member, and an elastic member to bias the operating lever toward a position where the operating lever connects the second connecting member and the third connecting member.

Preferably, but not necessarily, the operating lever may have a first rotating axis coaxially disposed with a rotation center of the first connecting member and a second rotating axis coaxially disposed with a rotation center of the second connecting member, and is configured, so that the second rotating axis is rotated about the first rotating axis.

Preferably, but not necessarily, the operating lever includes a first lever extended from the first rotating axis and a second lever connected with the first lever and disposed between the first rotating axis and the second rotating axis.

Preferably, but not necessarily, the first connecting member may be a pulley supporting an end of the connecting belt, the second connecting member may be a bearing rotatable by friction contact with the first connecting member, and the third connecting member may be integrally formed with the brush member to be rotatable by friction contact with the second connecting member.

According to another aspect of the present invention, there is provided a vacuum cleaner, including a cleaner body in which a suction force is produced by a suction motor, a brush member to separate dust or dirt from a surface to be cleaned while receiving a driving force from the suction motor to rotate, a blocking unit disposed between the brush member and the suction motor to selectively block a driving force transmission between the brush member and the suction motor, and a single connecting belt connecting between the suction motor and the blocking unit.

BRIEF DESCRIPTION OF THE DRAWING FIGURES

The above aspects and other advantages of the present invention will be more apparent by describing an exemplary embodiment of the present invention with reference to the accompanying drawing figures, in which.

In the drawing figures, it should be understood that like reference numerals refer to like features and structures.

DETAILED DESCRIPTION OF AN EXEMPLARY EMBODIMENT

Hereinafter, a vacuum cleaner having a brush apparatus according to an exemplary embodiment of the present invention will now be described in greater detail with reference to the accompanying drawing figures.

Figure 1:
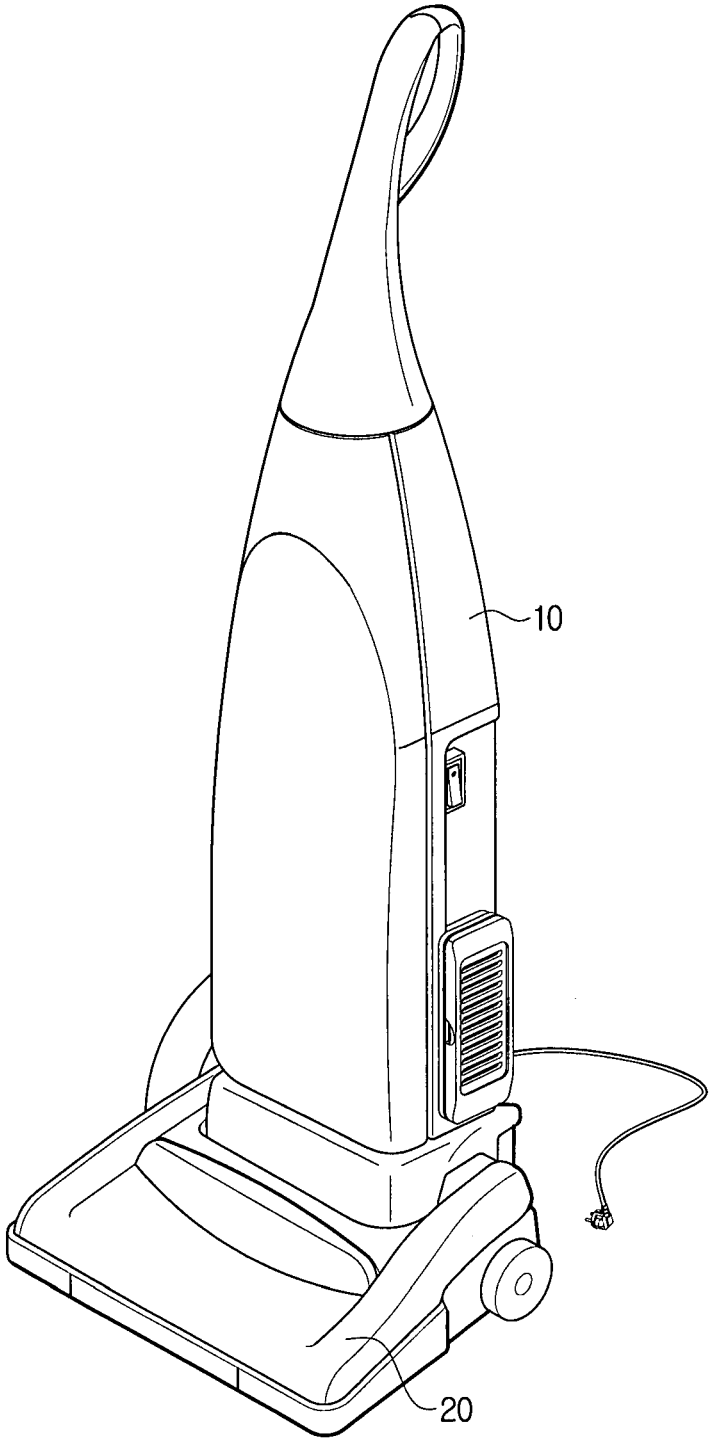
FIG. 1 is a perspective view of an upright vacuum cleaner in which a brush apparatus according to an exemplary embodiment of the present invention is employed.

As illustrated in FIG. 1, the vacuum cleaner according to the exemplary embodiment of the present invention includes a cleaner body 10 and a brush apparatus 20. In the exemplary embodiment of the present invention, although the vacuum cleaner is illustrated and explained as an upright vacuum cleaner in which the cleaner body 10 and the brush apparatus 20 are integrally formed, the present invention is not limited thereto.

Figure 2:
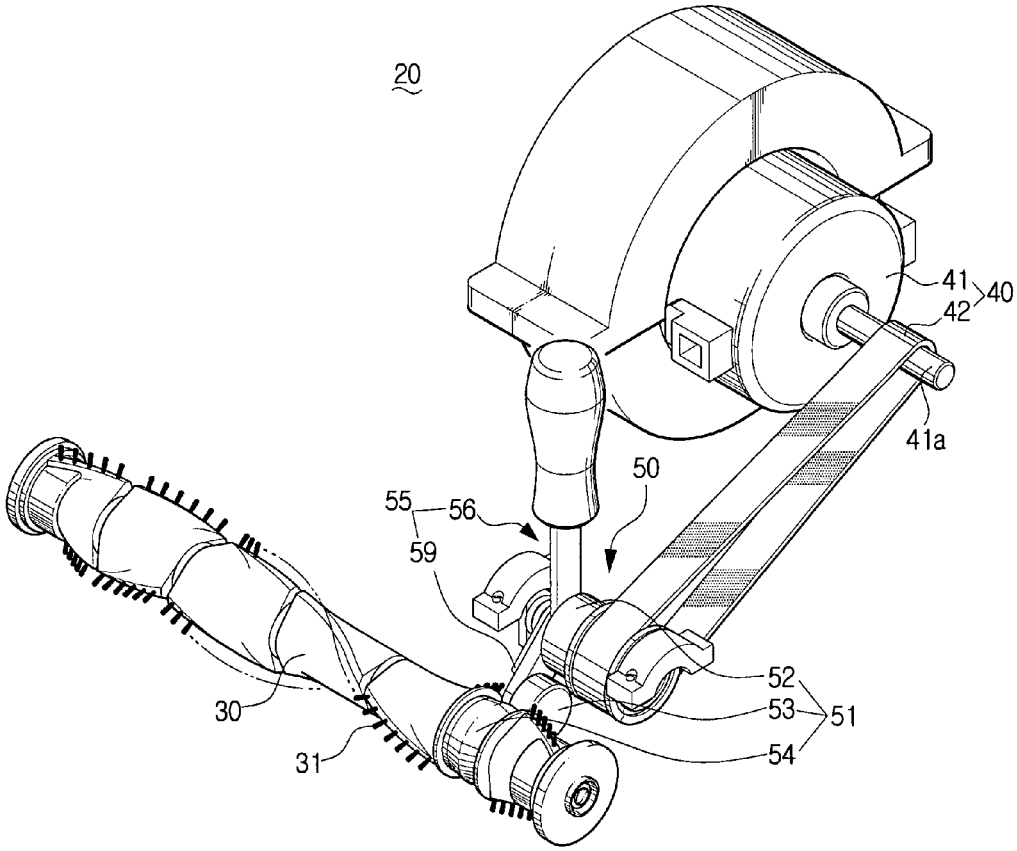
FIG. 2 is a perspective view of the brush apparatus of the vacuum cleaner illustrated in FIG. 1.
Figure 3:
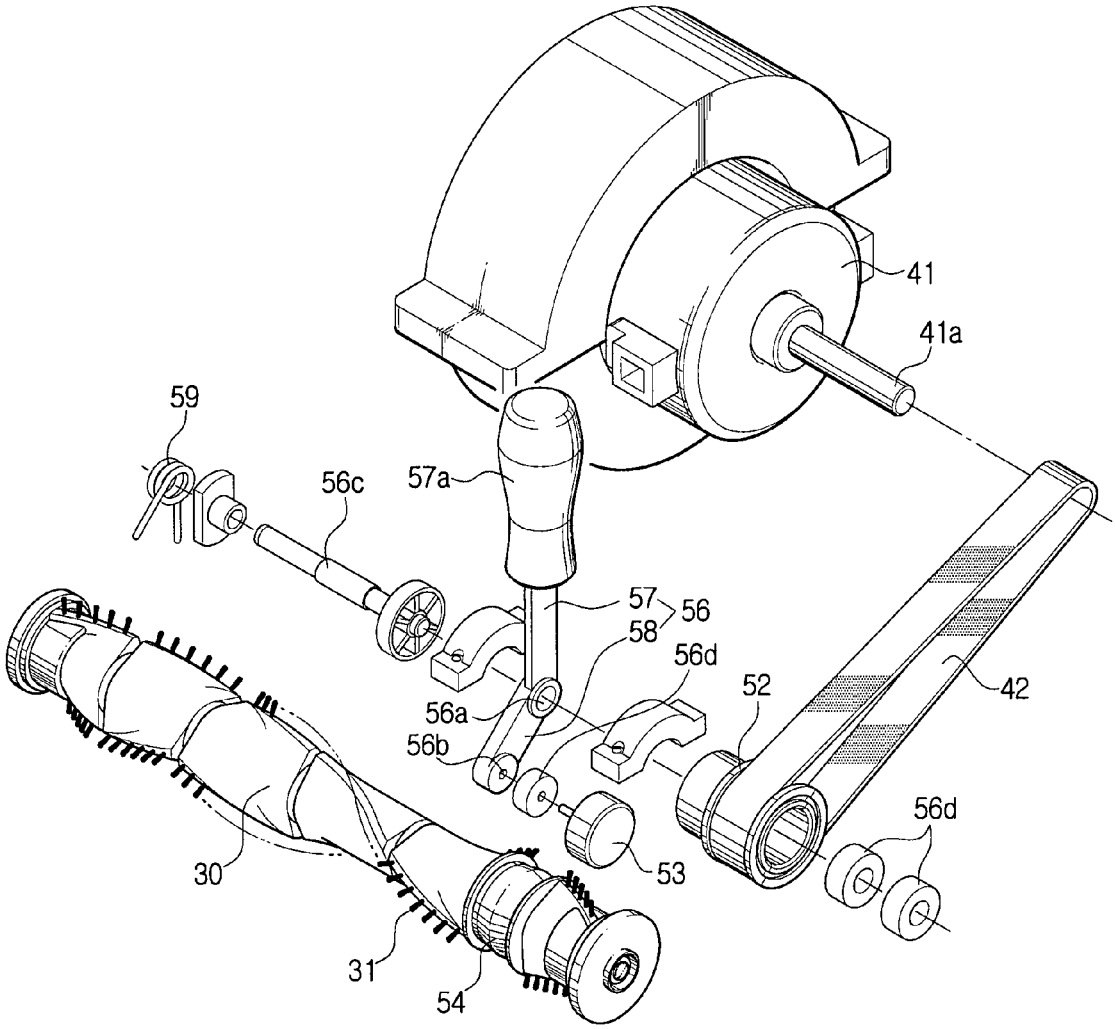
FIG. 3 is an exploded perspective view of the brush apparatus illustrated in FIG. 2.

The cleaner body 10 has a suction motor 41 FIG. 2 mounted therein to generate a suction force. The brush apparatus 20 cleans dust or dirt from a surface via a suction force generated from the cleaner body 10. As illustrated in FIGS. 2 and 3, the brush apparatus 20 includes a brush member 30, a driving unit 40, and a blocking unit 50.

The brush member 30 rotates along the surface to be cleaned scratching the dust or dirt of the surface to be cleaned, thereby separating the dust or dirt from the surface to be cleaned. Such a brush member 30 may be a fur brush, the outer surface of which includes a plurality of furs 31.

The driving unit 40 drives the brush member 30. For this, the driving unit 40 includes the suction motor 41 to generate the suction force, and a connecting belt 42 to transmit a driving force of the suction motor 41 to the brush member 30. A connecting belt 42 is supported on a driving axis 41*a* of the suction motor 41 at one end, and at the other end thereof, is supported by the blocking unit 50, so that the belt rotates along an endless track.

The blocking unit 50 is disposed between the brush member 30 and the driving unit 40, so that it selectively blocks the driving force transmission between the brush member 30 and the driving unit 40. The blocking unit 50 may be divided into a power transmitting part 51 and a blocking part 55.

The power transmitting part 51 transmits the driving force from the connecting belt 42, to the brush member 30, and includes a first, a second and a third connection members 52, 53 and 54. The first connecting member 52 is connected with the connecting belt 42. Preferably, the first connecting member 52 is formed as a pulley, which rotatably supports the end of the connecting belt 42.

The second connecting member 53 is connected with the first connecting member 52. Preferably, the second connecting member 53 is formed as a bearing, which rotates while receiving a rotating force due to friction with the first connecting member 52.

The third connecting member 54 is selectively connected with the second connecting member 53 by the blocking part 55, so that it drives the brush member 30. The third connecting member 54 is integrally formed with the brush member 30 at a and receives a rotating force due to friction with the second connecting member 53. The connection between the second connecting member 53 and the third connecting member 54 may be blocked when a slick surface is being cleaned, such as a bare floor.

To clean the slick surface, the blocking part 55 selectively blocks the driving force transmission between the power transmitting part 51 and the brush member 30. The blocking part 55 may include an operating lever 56 and an elastic member 59. The operating lever 56 selectively blocks a driving force transmission between the second connecting member 53 and the third connecting member 54. As illustrated in FIG. 3, the operating lever 56 has a first rotating axis 56*a* coaxially disposed with a rotation center of the first connecting member 52 and a second rotating axis 56*b* axially disposed with a rotation center of the second connecting member 53. A shaft 56*c* may be employed to fix the first rotating axis 56*a*.

Also, the operating lever 56 may be divided into a first lever 57 extended from the first rotating axis 56*a*, and a second lever 58 connected with the first lever 57 and disposed between the first rotating axis 56*a* and the second rotating axis 56*b*. Namely, the second lever 58 at one end thereof has the first rotating axis 56*a*, and at the other end thereof has the second rotating axis 56*b*. A handle 57*a* may be employed at an end of the first lever 57.

With the construction as described above, the first connecting member 52 and the first and the second levers 57 and 58 are rotated about the first rotating axis 56*a*, and the second connecting member 53 is rotated about the second rotating axis 56*b*. To smoothly rotate the first and second connecting members 52 and 53 and the first and the second levers 57 and 58, a plurality of bearings 56*d* are interposed on the first rotating axis 56*a* and the second rotating axis 56*b*.

An elastic or biasing member 59 elastically urges the operating lever 56 toward a position where the operating lever 56 connects between the second connecting member 53 and the third connecting member 54. The elastic member 59 is disposed on the first rotating axis 56*a* to elastically support a rotation of the operating lever about the first rotating axis 56*a*. Namely, the elastic member 59 returns the operating lever 56 rotated in a direction of A (FIG. 5) about the first rotating axis 56*a*, to its original position. As illustrated in FIG. 3, the elastic member 59 may be formed of a general torsion spring.

Hereinafter, an operation of the brush apparatus of the vacuum cleaner according to the exemplary embodiment of the present invention constructed as described above will now be explained with reference to FIGS. 4 and 5.

Figure 4:
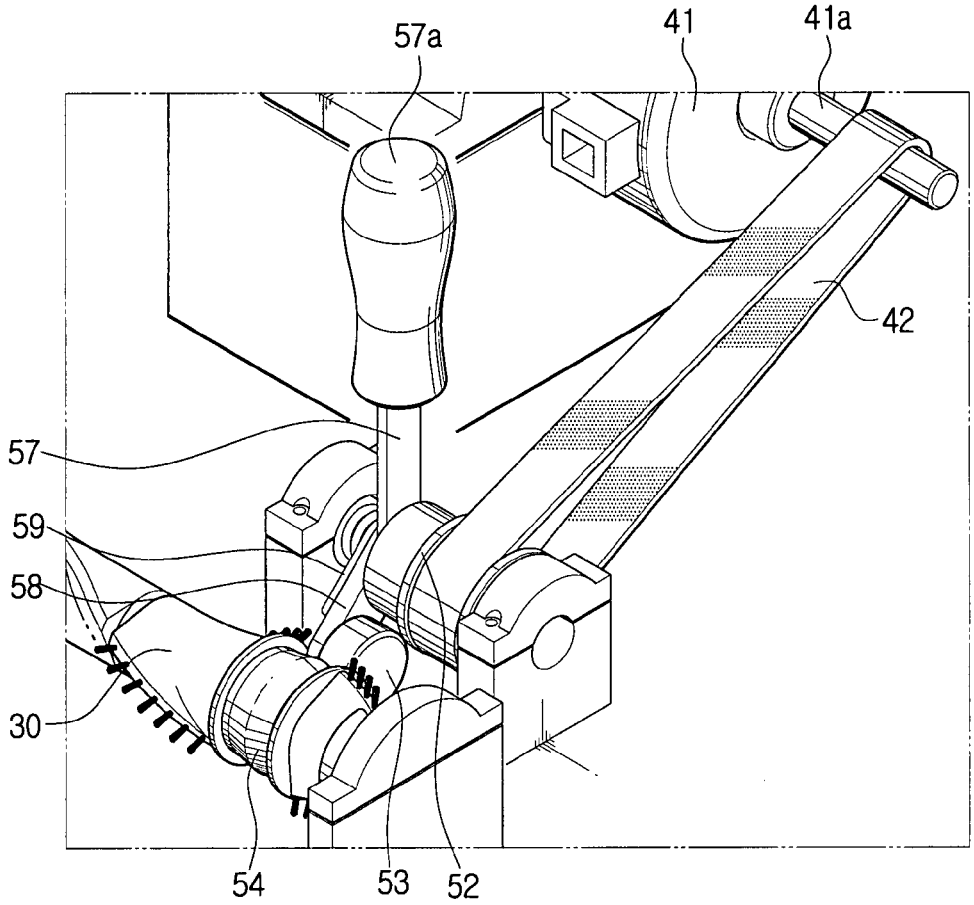
FIGS. 4 and 5 are enlarged partial perspective views of the brush apparatus showing states in which a driving force is transmitted and disconnected to and from a brush member by an operation of an operating lever.

As illustrated in FIG. 4, when a driving force of the suction motor 41 is transmitted to the first connecting member 52, through the connecting belt 42, the first and the second connecting members 52 and 53 are rotated together by the friction contact therebetween. Also, a rotating force of the second connecting member 53 is transmitted to the third connecting members 54 by the friction contact therebetween. Accordingly, the driving force of the suction motor 41 is transmitted to the brush member 30 (integrally formed with the third connecting member 54) via the first through third connecting members 52-54, to rotate the brush member 30.

With such a rotation of the brush member 30, the plurality of furs 31 on the outer surface of the brush member 30 strike or scratch the surface to be cleaned, so that dust or dirt is separated from the surface to be cleaned.

Figure 5:
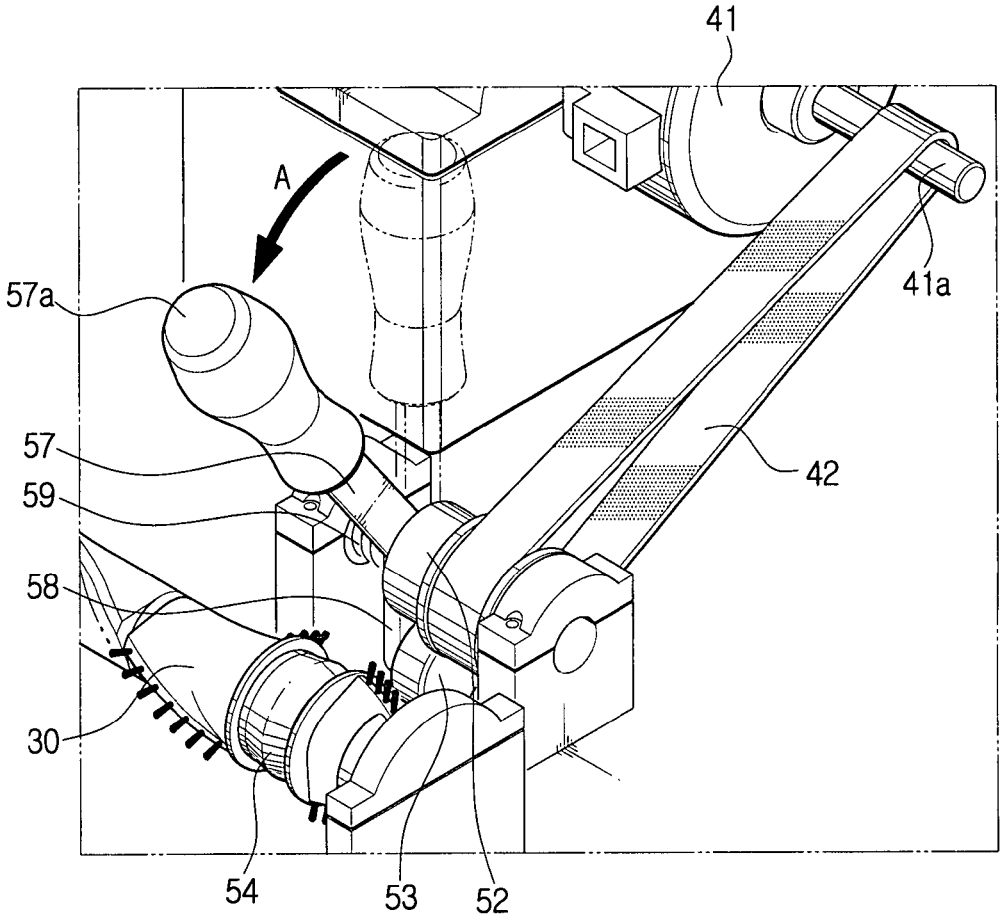

If a slick or bare surface is being cleaned the operating lever 56 is rotated in a direction A, as illustrated in FIG. 5. In that case, the first lever 57 is rotated in the direction A about the first rotating axis 56*a*, and in combination with the first lever 57, the second lever 58 is rotated in the direction of A about the first rotating axis 56*a*. At that time, the second connecting member 53, which is coaxially disposed with the second rotating axis 56*b* formed on the other end of the second laver 58, also rotates in the direction A.

The contact between the second connecting member 53 and the third connecting member 54 is released, so that the rotating force of the second connecting member 53 is not transmitted to the third connecting member 54. Accordingly, the brush member 30 stops rotating, allowing the cleaner to carry out the cleaning operation without damaging the slick surface being cleaned.

As apparent from the foregoing description, according to the exemplary embodiment of the present invention, construction is simplified because only a single suction motor and a single connecting belt is employed, to provide selective blocking of the brush rotation. Accordingly, the brush apparatus and the vacuum cleaner having the same according to the exemplary embodiment of the present invention reduces fabrication costs.

Also, the brush apparatus and the vacuum cleaner according to the exemplary embodiment of the present invention selectively blocks the drive of the brush member when cleaning a slick surface, thereby preventing that surface from being damaged due to the friction with the brush member.

Although a representative exemplary embodiment of the present invention has been shown and described in order to exemplify the principle of the present invention, the present invention is not limited to the specific exemplary embodiment. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. A brush apparatus, comprising:

a rotatable brush member;

a driving unit that rotates the brush member; and a blocking unit disposed between the brush member and the driving unit configured to selectively block a driving force transmitted between the brush member and the driving unit, wherein the driving unit comprises:

a suction motor to generate a suction force; and a single continuous connecting belt connecting the suction motor and the blocking unit, wherein the blocking unit comprises:

a power transmitting part to transmit the driving force transmitted from the single connecting belt to the brush member; and a blocking part to selectively block the driving force transmitted between the brush member and the power transmitting part, wherein the power transmitting part comprises:

a first connecting member coupled with the connecting belt;

a second connecting member coupled with the first connecting member; and a third connecting member disposed on the brush member to be selectively coupled with the second connecting member by the blocking part so as to drive the brush member, and wherein the second connecting member comprises a bearing rotatable by friction contact with the first connecting member.

2. The apparatus of claim 1, wherein the blocking part comprises:

an operating lever to selectively block the driving force transmission between the second connecting member and the third connecting member; and an elastic member biasing the operating lever toward a position where the operating lever connects the second connecting member and the third connecting member.

3. The apparatus of claim 2, wherein the operating lever has a first rotating axis coaxially disposed with a rotation center of the first connecting member and a second rotating axis coaxially disposed with a rotation center of the second connecting member, the operating lever being configured so that the second rotating axis is rotated about the first rotating axis.

4. The apparatus of claim 3, wherein the operating lever comprises a first lever extended from the first rotating axis and a second lever connected with the first lever and disposed between the first rotating axis and the second rotating axis.

5. The apparatus of claim 4, wherein the first lever has a handle.

6. The apparatus of claim 3, wherein the elastic member is disposed on the first rotating axis.

7. The apparatus of claim 1, wherein the first connecting member comprises a pulley supporting an end of the connecting belt, and the third connecting member being integrally formed with the brush member and rotatable by friction contact with the second connecting member.

8. The apparatus of claim 1, wherein the blocking unit comprises:

a pulley connected with the connecting belt;

a rotating member integrally formed with the brush member;

a power transmitting member disposed between the pulley and the rotating member;

an operating lever configured to selectively block the driving force transmitted between the power transmitting member and the rotating member; and an elastic member biasing the operating lever toward a position where the operating lever connects between the power transmitting member and the rotating member.

9. The apparatus of claim 8, wherein the operating lever has a first rotating axis coaxially disposed with a rotation center of the pulley and a second rotating axis coaxially disposed with a rotation center of the power transmitting member, and is configured, so that the second rotating axis is rotated about the first rotating axis.

10. A vacuum cleaner, comprising:

a cleaner body in which a suction force is produced by a suction motor;

a rotatable brush member for separating dust or dirt from a surface to be cleaned while receiving a driving force from the suction motor;

a blocking unit disposed between the brush member and the suction motor to selectively block the driving force transmitted between the brush member and the suction motor; and a single continuous connecting belt connecting the suction motor and the blocking unit, wherein the blocking unit comprises:

a power transmitting part to transmit the driving force transmitted from the connecting belt to the brush member; and a blocking part to selectively block the driving force transmitted between the brush member and the power transmitting part, wherein the power transmitting part comprises:

a first connecting member coupled with the connecting belt;

a second connecting member coupled with the first connecting member; and a third connecting member disposed on the brush member to be selectively coupled with the second connecting member by the blocking part so as to drive the brush member, and wherein the second connecting member comprises a bearing rotatable by friction contact with the first connecting member.

11. The cleaner of claim 10, wherein the blocking part comprises:

an operating lever to selectively block the driving force transmitted between the second connecting member and the third connecting member; and an elastic member biasing the operating lever toward a position where the operating lever connects between the second connecting member and the third connecting member.

12. The cleaner of claim 11, wherein the operating lever has a first rotating axis coaxially disposed with a rotation center of the first connecting member and a second rotating axis coaxially disposed with a rotation center of the second connecting member, and is configured, so that the second rotating axis is rotated about the first rotating axis.

13. The cleaner of claim 12, wherein the operating lever comprises a first lever extended from the first rotating axis and a second lever connected with the first lever and disposed between the first rotating axis and the second rotating axis.

14. The cleaner of claim 13, wherein the first lever has a handle.

15. The cleaner of claim 12, wherein the elastic member is disposed on the first rotating axis.

16. The cleaner of claim 10, wherein the first connecting member comprises a pulley supporting an end of the connecting belt, and the third connecting member integrally formed with the brush member and rotatable by friction contact with the second connecting member.

* * * * *